US006491761B1

(12) United States Patent
Wray et al.

(10) Patent No.: US 6,491,761 B1
(45) Date of Patent: Dec. 10, 2002

(54) PROCESS FOR REMOVING STAINS FROM STEEL SHEET IN A CONTINUOUS PICKLING LINE

(75) Inventors: John W. Wray, Dublin, OH (US); Darrell E. Murphy, Valparaiso, IN (US); Michael Pilnock, Portage, IN (US)

(73) Assignee: Bethlelem Steel Corporation

( * ) Notice: Subject to any disclaimer, the term of this patent is extended or adjusted under 35 U.S.C. 154(b) by 44 days.

(21) Appl. No.: 09/624,113

(22) Filed: Jul. 24, 2000

(51) Int. Cl.[7] ..... C23G 1/00

(52) U.S. Cl. ..... 134/15; 134/2; 134/37; 134/64 R; 34/306; 34/399; 34/419; 34/444; 34/448; 34/463

(58) Field of Search ..... 134/2, 15, 32, 134/37, 42, 64 R; 34/306, 399, 419, 444, 448, 463, 499

(56) References Cited

U.S. PATENT DOCUMENTS

| | | | | | |
|---|---|---|---|---|---|
| 3,632,453 | A | * | 1/1972 | Patterson | 134/41 |
| 4,270,317 | A | * | 6/1981 | Kurie | 134/64 R |
| 4,383,898 | A | * | 5/1983 | Renton | 134/29 |
| 4,901,744 | A | * | 2/1990 | Hansen | 134/108 |
| 5,095,926 | A | * | 3/1992 | Wegner | 134/111 |
| 5,188,135 | A | * | 2/1993 | Neumann et al. | 134/122 R |
| 5,377,398 | A | * | 1/1995 | Bessey | 134/41 |
| 5,412,966 | A | * | 5/1995 | Neese et al. | 134/113 |
| 5,879,465 | A | * | 3/1999 | McKevitt et al. | 134/15 |
| 6,093,256 | A | * | 7/2000 | Dwiggins et al. | 134/15 |
| 6,250,902 | B1 | * | 6/2001 | Dwiggins et al. | 134/153 |
| 6,314,975 | B1 | * | 11/2001 | Nerat et al. | 134/122 R |

* cited by examiner

*Primary Examiner*—Randy Gulakowski
*Assistant Examiner*—J Smetana
(74) *Attorney, Agent, or Firm*—Harold I. Masteller, Jr.

(57) ABSTRACT

The present invention is directed to a mothod for preventing the formation of additional surface stains on destained steel sheet processed in a continuous pickle line operation.

19 Claims, 1 Drawing Sheet

PROCESS FOR REMOVING STAINS FROM STEEL SHEET IN A CONTINUOUS PICKLING LINE

BACKGROUND OF THE INVENTION

1. Field of the Invention

This invention is directed to continuous pickling operations, and in particular, it is directed to apparatus and a method for improving surface quality in continuous hot-rolled steel sheet product by removing surface stains that may appear on the finished steel product if the pickling line needs to be stopped for any one of a variety of reasons. For example, during normal pickling operations new coils of steel sheet product are repeatedly spliced onto the trailing end of sheet steel product running through the pickle line. If the length of the sheet steel product held within the looper section of the line is not long enough to provide the necessary time to complete the splice, the line must be stopped. Additionally, pickle lines are routinely stopped for unscheduled maintenance and/or repair. They are also stopped to make minor line adjustments, and at times are even stopped because of power failures. During such line stops, long sections of pickled and partially pickled steel sheet product, for example up to 100' or more in length, are disproportionately exposed to the pickle liquor and/or acid fume above the pickling tanks. Such prolonged exposure results in the reformation of iron oxides, or stains, onto the surface of the sheet product.

2. Brief Description of the Related Art

Various attempts have been made in the past to remove stains from pickled sheet steel product. One such past attempt is disclosed in U.S. Pat. No. 5,916,379 granted to Varley, et al. The patent is directed to a composition and method of using the composition to prevent surface staining (flash rusting) on steel sheet in a continuous pickling line. The inventors disclose using an aqueous solution comprising about 3%–15% by weight each of gluconate and citrate to prevent the formation of flash rust during a line stop. The rust inhibiting solution is applied in the rinse zone of the pickle line. Such rinse zone stain removers are referred to in the art as "post-treatment" stain removers.

Another post-treatment stain remover process, disclosed in U.S. Pat. No. 5,837,061, prevents formation of hydrolysis stains on sheet steel product. The post-treatment process includes proving an inert gas or $CO_2$ atmosphere in the rinse zone of the pickle line to prevent staining.

A third Patent, U.S. Pat. No. 5,296,042, recognizes various problems associated with staining in pickling operations. The Patent teaches that although many compositions are known to remove stain from sheet steel, it is extremely difficult to effectively apply stain-removing compositions to sheet steel surfaces in a continuous high speed manufacturing line. The inventors further state that when hot rolled sheet steel is pickled with HCl, the product can suffer from iron and chloride staining during line stops, and that the efficiency of stain removing chemicals is directly related to rinsing techniques. The Patent teaches that "rinsing is of major importance" in any process that attempts to remove the residual chloride ions that contribute to the formation of stain on pickled stain surfaces.

Another U.S. Pat. No. 4,389,254, discloses that when inorganic acids are used as a pickle liquor, it tends to cause surface marks and pitting on the steel sheet product. In order to overcome this problem, the inventors use carefully selected organic pickle liquor in their pickle tanks, for example formic acid, acetic acid, or citric acid.

U.S. Pat. No. 4,361,444 discloses a post pickling rinse process that includes a rapid and uniform air drying step to prevent water spotting on strip.

Finally, U.S. Pat. No. 1,902,815 is directed to a process for pickling sheet steel in a sulfuric acid bath at a temperature of about 200° F. The pickled product is then squeezed between wringer rolls, rinsed with water sprays, and the rinsed sheet is given a final wipe between a last set of wringer rolls. A blast of hot air from upper and lower air blast nozzles provides a final drying step. The Patent discloses providing a continuous forced blast of hot air against the sheets to dry all water from both surfaces.

It appears that the more effective stain removing processes developed in the past include a post-treatment stain remover used in combination with spray or immersion type rinse steps. We have found, in actual continuous hot rolling operations, that such past stain removing processes still fail to completely remove all surface staining caused by pickle line stops. For instance, we have found that even the best post-treatment stain removers tend to leave about a 1-inch wide brown stain along both edges of the pickled sheet after the drying step is completed. It is believed that such staining is caused by the retention of residual stain remover solution along the edges of the continuous pickled sheet steel product after the drying operation is completed. We have also discovered that when we use such post-treatment stain removers in combination with an improved post-rinse strip drying process developed at our operation, stain removal is improved to where the 1-inch brown stain is completely removed or at least reduced to where it has little effect on the product. For example, when we use a post-treatment stain remover, such as a new Crown formula sold as (NCI-SRU), in combination with the improved air knife arrangement and drying-process of the present invention, the 1-inch brown stain is completely removed. The new air knife arrangement is located downstream of the last wringer roll in of the line, and it delivers a fan shaped blast of drying air that radiates outward from the center of the steel sheet product toward both continuous edges of the sheet. The blast of drying air from the air knives impacts upon the last wringer roll to prevent water "drag-out" along the downstream edge of the roll, and the outward radiating blast of drying air drives any excess rinse toward and off the continuous edges of the pickled sheet product.

SUMMARY OF THE INVENTION

It is therefore an object of the present invention to provide an improved process for removing stains from a pickled sheet product.

It is a further object of the present invention to provide an improved rinse/dry process that eliminates edge staining on a pickled sheet product.

It is another object of the present invention to provide an improved spray and air knife arrangement that removes residual stain remover solution from the edges of a pickled sheet product.

In satisfaction of the foregoing objects and advantages, the present invention provides a continuous pickle line that includes an improved air knife arrangement adapted to provide an airflow along the surface of a continuous steel sheet processed in the continuous pickle line. The airflow impacts against the exit side of the roll gap located between a set of wringer rolls that contact the continuous steel sheet, and the force of the airflow impacting against the roll gap is sufficient to prevent rinse water drag-out between the set of wringer rolls and onto the dried surface of the continuous sheet being processed. The airflow in combination with a post-treatment stain remover applied in the rinse zone of the continuous pickle line improves surface quality when the continuous sheet being processed is subjected to a line stop.

DETAILED DESCRIPTION OF THE PREFERRED EMBODIMENT

Figure 1:
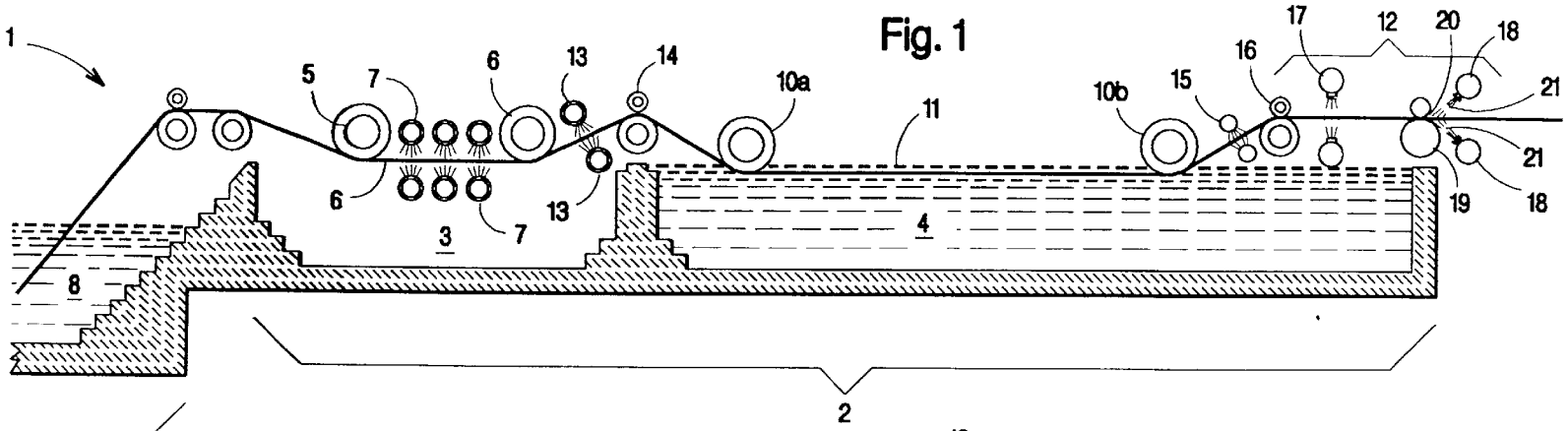
FIG. 1 is a cross-section view taken through the rinse zone of a continuous pickle line.

Steel sheet is pickled in an acid bath e.g. hydrochloric acid, contained in a series of acid tanks 8. In most instances, a continuous pickle line comprises between about three to five acid tanks that are aligned to provide an effective bath length of between about 250 to 300 feet. The continuous steel sheet is immersed into the acid bath which removes dirt, grease, and scale from the surface of a continuous sheet of steel 6 before rolling the steel into a finished sheet product. If the pickle line is stopped for any reason, as heretofore mentioned above, staining of the product surface is inevitable if the line stop extends beyond a critical time that causes hydrolysis reactions to begin staining the product surface. In a modem high-speed continuous hot-strip line, a prolonged line stoppage will affect long sections of steel sheet product that are trapped within the pickling zone 9. The trapped lengths of unfinished steel sheet product are disproportionately exposed to the pickle liquor and/or acid fume above the pickling tanks, and their extended exposure to an acid environment causes surface staining. Prolonged line stops also affect long lengths of steel sheet product that are trapped in the rinse zone 2 of pickle line 1. Portions of the trapped sheet product are exposed to the air and they tend to flash dry. This may cause hydrolysis reactions that form iron oxides or stains on the sheet surface. If operators find that they are not able to remove such oxide stains from the steel sheet surface, the affected lengths must be discarded as waste product.

In a continuing attempt to improve product quality through the reduction or elimination of oxide stains related to pickle line stops, various different stain remover solutions were tested in the hot-water bath contained in rinse tank 4. One such tested additive is a new stain remover formula sold by Crown as NCR-SRU. During testing, it was discovered that the new Crown formula appeared to be one of the more effective stain removers at our pickle line operation. Therefore, the following description refers to the preferred Crown formula, NCR-SRU. However, it should be understood that any suitable post-treatment stain remover solution may be used without departing from the scope of the present invention.

The Crown NCR-SRU formula is a post pickling stain remover, viz. it removes acid and hydrolysis stains downstream from the pickle zone 9. However, it was discovered that even though the Crown stain remover appears to be one of the more effective stain remover solutions used at our operation, it continued to leave about a 1-inch wide brown stain along each continuous edge of the pickled, rinsed, and dried steel sheet product if the pickle line was subjected to a line stop. It is believed that the 1-inch brown edge stain may be the result of chloride residues left behind after the final rinse and drying steps.

The continuing attempt to improve product quality was also directed to overcoming the edge-stain problem associated with pickled sheet steel subjected to line stops. Different stain remover additives and formula changes were tried in the hot-water bath to solve the problem. For instance, at our request, Crown developed a non-chloride containing stain remover for use in rinse tank 4 at our continuous pickle line. The formula change failed to eliminate the 1-inch wide brown edge stain on our strip. In another attempt to solve the problem, we added citric acid to rinse tank 4 containing the Crown NCR-SRU solution. The citric acid additive also failed to remove the edge stains. Finally, a wetting agent was added to rinse tank 4 in an attempt to prevent the strip from drying too quickly and flash rusting during a prolonged line stop. This attempt also failed to eliminate the stains. It was then discovered that if the Crown solution was used in combination with an improved sheet drying process, the 1-inch wide brown edge stains were either completely removed or reduced to a width that had little effect on finish product quality. Such an acceptable stain is about ¼ inch wide or smaller. Surprisingly, it was discovered that an improved air knife arrangement and drying method, located downstream of rinse tank 4, and used in combination with the Crown NCI-SUR stain remover, will provide improved edge stain removal when compared with stain removing processes of the past.

Prior to our discovery of a new air knife system and method, the Burns Harbor pickle line used an air knife arrangement similar to the apparatus in U.S. Pat. No. 1,902,815 disclosed above. The Patent teaches that drying is critical in a pickling operation, and it discloses using sheet drying apparatus that provides a top and bottom blast of hot air against the pickled sheet product as it moves away from the last wringer roll on the line. Careful observation during testing under actual mill conditions revealed that the last wringer roll in a pickle line tends to drag rinse water from the hot-water rinse and downstream of the drying zone. The "drag-out" of excess rinse water from the drying zone rewets the strip edges, and past air knife arrangements as disclosed in the 815 Patent fail to drive the excess rinse water from the strip edges. It is believed that the remaining drag-out water contains chloride ions from the stain remover contained in the rinse and the chloride ions precipitate out as the water evaporates, depositing oxides or stains along both strip edges.

In the preferred embodiment of the present invention such edge staining is eliminated, or at least reduced to only a minor problem, by providing an improved air knife system located adjacent the exit side of the last wringer roll in the drying zone.

Figure 2:
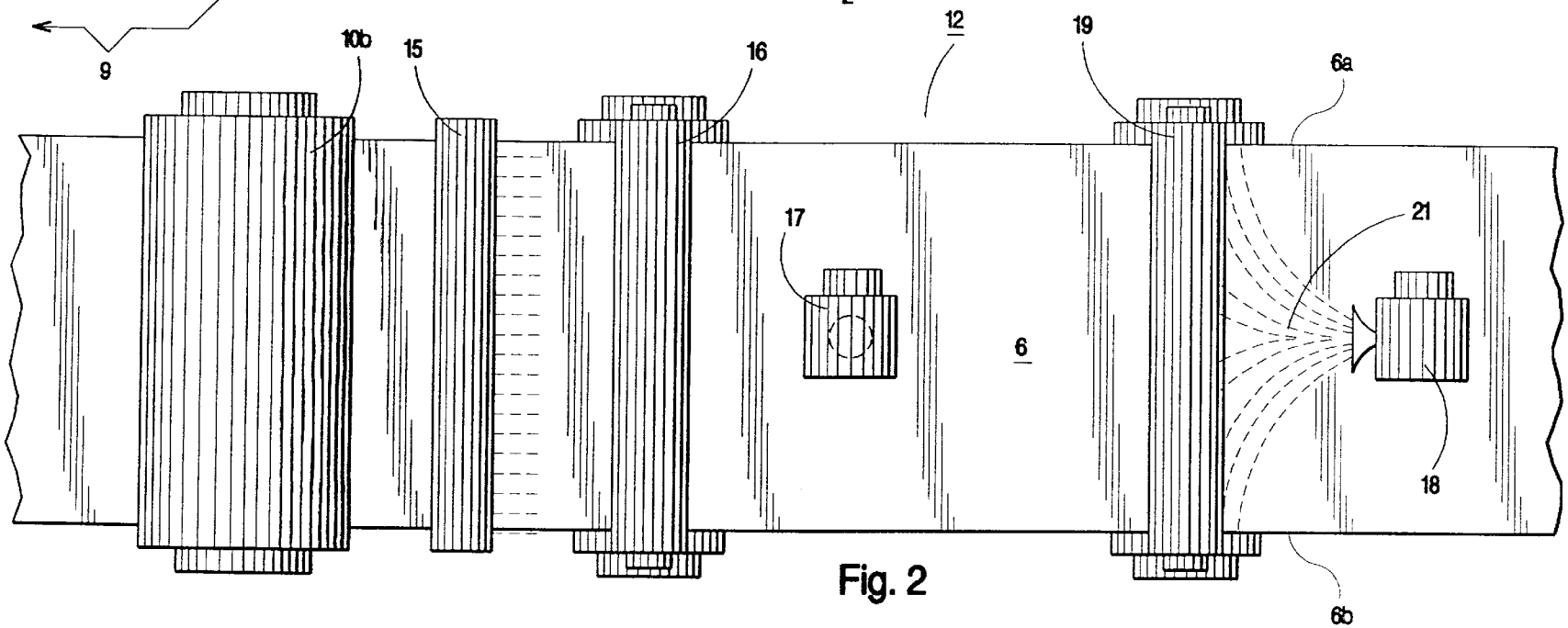
FIG. 2 is a plan view showing the drying section of the rinse zone shown in FIG. 1.

Referring to FIGS. 1 and 2 showing the preferred embodiment of the present invention, the rinse zone 2 of a continuous pickling line 1 is shown comprising a cold-water spray rinse section 3 and a hot-water rinse tank 4. The cold-water spray rinse section 3 includes at least two dunk rolls 5 that position the pickled steel sheet product 6 between a plurality of spaced apart sprays 7. The spraywash acid carry over off the surface of the steel sheet as it emerges from the last acid tank 8 in a series of acid tanks located in the pickling zone 9 of the continuous pickling line. The hot-water tank includes sinker roll 10*a* and 10*b* that immerse the pickled steel sheet 6 into a hot water bath 11 to complete the rinsing process and warm the pickled steel sheet 6 to promote flash drying of the pickled steel sheet when it enters the drying zone 12 located downstream from the hot-water rinse tank 4.

In the present invention, the pickled steel sheet 6 exits the last acid bath tank 8 and enters rinse section 3 where the pickled steel sheet is spray rinsed between cold water sprays 7. The rinsed sheet 6 exits rinse section 3 through a final cold water rinse between sprays 13 and the rinsed sheet product is squeezed between a set of wringer rolls 14 before the pickled steel sheet is immersed into the hot water bath 11 by the entrance side sinker roll 10*a*. In the preferred embodiment, the hot-water bath 11 is a post-treatment stain remover solution comprising a concentration of about 1.5 to about 2.5% post-treatment stain remover added to the hot water with an aim concentration of about 2.0% post-treatment stain remover, and the bath is maintained within a temperature range of between about 150–190° F. with a preferred rinse bath temperature of about 160° F. The continuous steel sheet 6 exits the hot-rinse tank 4 and passes between sprays 15 that deliver a final hot water spray rinse pumped from the post-treatment stain remover solution 11 contained in the hot-rinse tank.

The rinsed and treated pickled steel sheet continues to move downstream from the sprays 15 and is squeezed between another set of wringer rolls 16 before it enters the drying zone 12 where it receives a first blast of air from top and bottom positioned air blowers 17 that dry both surfaces of the pickled sheet. The pickled steel sheet is squeezed between a last set of wringer rolls 19 and moves downstream toward pinch rolls (not shown) for further processing into a finished rolled sheet steel product.

An improved air knife system 18 is located adjacent the exit side of the last wringer roll set 19 to provide a blast of air that impacts upon the roll gap 20 along the exit side of the wringer roll set 19. Roll gap is a well known term used within the art of steelmaking to indicate the distance between opposed work roll surfaces in a roll set or mill stand, and in this instance, roll gap is also used to indicate the distance between opposed wringer roll surfaces in a wringer roll set. The impacting air blast prevents or reduces "drag-out" of excess rinse water 11 onto the pickled steel surface downstream of drying zone 12. Past air knife arrangements, as disclosed in U.S. Pat. No. 1,902,815, fail to drive the excess rinse water from the strip, and in particular, from the continuous strip edges 6*a* and 6*b*, where the excess rinse water rewets the strip edges causing the brown staining as disclosed above. It is believed that the remaining drag-out water contains chloride ions from the stain remover contained in tank 4, and the chloride ions procipitate out as tho water evaporates, depositing oxides or stains along both strip edges.

In the preferred embodiment of the present invention such edge staining is eliminated, or at least reduced to only a minor problem, by providing a top and bottom hot water spray 15 in combination with the improved air knife apparatus arrangement 18. The hot water sprays are located between the exit side sinker roll 10*b* and wringer roll 16 and the improved air knife arrangement is positioned adjacent the exit side of the last wringer roll 19. The improved air knife apparatus delivers a fan shaped blast of cold air 21 as compared to the steel sheet temperature, for example, at ambient temperature or lower. As shown in FIG. 2, the top and bottom air knives 18 are positioned adjacent the downstream side of the last wringer roll 19 where they provide a blast of cold air that impacts directly into and along the length of the roll gap 20 in the set of last ringer rolls 19. The blast of cold air also radiates outward toward the continuous strip edges 6*a* and 6*b* and drives excess rinse water back into the rinse zone 2 to prevent rinse water drag-out through the roll gap 20. The fan shaped pattern of cold air 21 is produced by the top and bottom air knives 18 to drive any rinse water drag-out toward and off the strip edges 6*a* and 6*b*.

Additionally, It has been found that the roll gap setting 20 in the last wringer roll 19 has a direct influence on stain removal results. That is to say, when the improved drying process of the present invention is used with an increased last wringer roll gap selfing, for example, about a 2 inch roll gap on the apparatus in use at our present pickling operation, stain removal is improved as compared to the same drying process with a smaller last wringer roll gap setting that produces a contract pressure similar to other wringer roll sets positioned along the continuous pickle line. An increased last wringer roll gap setting of about 2 inches on our present apparatus produces substantially no contact pressure against the surface of the moving pickled sheet steel product. This is a reduced contact pressure and a larger roll gap setting when compared to the other wringer rolls, for example 14 and 16, that are spaced apart at different locations along rinse zone 2. Therefore, it has been discovered that stain removal in a continuous pickling line is improved when a fan-shaped blast of cold air 21 impacts upon the exit side roll gap in a last wringer roll set adjusted to apply a reduced roll contact pressure against a pickled steol sheet product treated in the continuous pickle line.

While this invention has been described as having a preferred design and method of operation, it is understood that it is capable of further modifications, uses, and/or adaptations following in general the principle of the invention and including such departures from the present disclosure as come within known or customary practice in the art to which the invention pertains, and as may be applied to the essential features set forth herein, and fall within the scope of the invention limited by the appended claims.

We claim:

1. In a continuous pickle line including a rinsing zone containing a hot-rinse, and a drying zone including air-blow dryers and spaced apart wringer roll sets, an improved method for preventing the formation of surface stains on a continuous destained steel sheet processed in the continuous pickle line, the improved method comprising:

a) providing at least one air knife that delivers an airflow along at least one surface of the continuous steel sheet; and b) positioning said at least one air knife so that said airflow impacts against an exit side of a roll gap between wringer rolls in at least one of the wringer roll sets, said airflow impacting said roll gap at a force sufficient to prevent rinse water drag-out by the continuous destained steel sheet feeding through the roll gap.

2. The method recited in claim 1 wherein the air knife of step b) provides a fan shaped airflow impacting on the exit side of the roil gap and radiating in an outward direction along said at least one surface toward edges of the continuous destained steel sheet.

3. The method recited in claim 1 including the further step, comprising:

a) Maintaining said at least one airflow at a temperature below the temperature of the continuous steel sheet.

4. The method recited in claim 3 including the further step, comprising:

a) maintaining said at least one airflow at ambient temperature or lower.

5. The method recited in claim 1 including the further step, comprising:

a) adjusting the roll gap is so that said at least one of the spaced apart wringer rolls contacts the continuous steel sheet at a pressure that is less than a contact pressure applied by the other spaced apart wringer rolls that contact the continuous steel sheet.

6. The invention recited in claim 5 wherein the roll gap is adjusted so that no contact pressure is applied against the continuous destained steel sheet.

7. The invention recited in claim 1 including before step a):

a) providing in said rinse zone, a hot-rinse bath containing a post-treatment stain remover solution; and b) applying said hot-rinse bath to continuous pickled steel sheet.

8. The invention recited in claim 1 including the further steps, comprising:

a) providing in said rinse zone, a hot-rinse spray containing a post-treatment stain remover solution; and b) applying said hot-rinse spray to the continuous steel sheet into said hot-rinse bath.

9. The invention recited in claim 8 including the further steps, comprising:

a) maintaining said hot-rinse bath at a concentration range of about 1.5 to 2.5% post-treatment stain remover in water; and b) maintaining said hot-rinse spray at a concentration range of about 1.5 to 2.5% post-treatment stain remover in water.

10. The invention recited in claim 8 including the further steps, comprising:

a) maintaining said hot-rinse bath at a temperature range of about 150–190° F.; and b) maintaining said hot-rinse spray at a temperature range of about 150–190° F.

11. A method for preventing the formation of surface stains on destained pickled steel sheet processed in a continuous pickling line operation, the steps of the method comprising:

a) destaining the pickled steel sheet with a stain remover solution;

b) feeding said destained steel sheet through a first wringer roll set;

c) directing an air blast against said destained steel sheet;

d) feeding said treated steel sheet through a last wringer roll set; and e) directing an air wipe to impact against an exit side of a roll gap between wringer rolls in said last wringer roll set, said air wipe impacting at a force sufficient to prevent solution drag-out by said destained steel sheet feeding through said roll gap, said elimination of solution drag-out preventing tormation of additional surface stains on the continuous destained steel sheet.

12. The method recited in claim 11 wherein the air wipe of step e) is fan shaped, said fan shaped air wipe impacting on the exit side of said roll gap and radiating in an outward direction toward the edges of the destained steel sheet at a force sufficient to prevent solution drag-out onto the continuous destained steel sheet.

13. The method recited in claim 11 wherein the air wipe of step e) is at a temperature below a temperature of the destained steel sheet.

14. The method recited in claim 11 wherein the air wipe of step e) is at ambient temperature or lower.

15. The method recited in claim 11 wherein the roll gap of step e) is adjusted to apply a wringer roll contact pressure against the destained steel sheet less than a wringer roll contact pressure applied by said first wringer roll set.

16. The method recited in claim 15 wherein the roll gap is adjusted to apply a wringer roll contact pressure against the destained steel sheet less than a wringer roll contact pressure applied by other wringer roll sets positioned along the pickle line.

17. The method recited in claim 15 wherein the roll yap is adjusted so that no wringer roll contact pressure is applied against the destained steel sheet.

18. The method recited in claim 11 wherein step a) further includes treating surface stained pickled steel sheet with a stain remover solution having a concentration of about 1.5 to 2.5% post-treatment stain remover in water.

19. The method recited in claim 11 wherein step a) further includes treating surface stained pickled steel sheet with a stain remover solution maintained at a temperature range of about 150–190° F.

* * * * *